United States Patent [19]

van Hoof et al.

[11] Patent Number: 4,568,902

[45] Date of Patent: Feb. 4, 1986

[54] CONTACT PIECE FOR AIR-COOLED TRANSFORMERS HAVING CONDUCTIVE LINES

[75] Inventors: Johannes W. P. van Hoof, Rozenhof; Hermanus A. M. Awater, Beuningen, both of Netherlands

[73] Assignee: Smit Transformatoren B.V., Netherlands

[21] Appl. No.: 480,754

[22] Filed: Mar. 31, 1983

[30] Foreign Application Priority Data

Apr. 2, 1982 [DE] Fed. Rep. of Germany ..... 3212335

[51] Int. Cl.[4] ..... H01F 33/00

[52] U.S. Cl. ..... 336/10; 339/113 R; 339/151 R; 339/198 E; 339/222

[58] Field of Search ..... 339/222, 198 J, 198 E, 339/198 C, 194 R, 150 T, 113 R, 113 B, 242, 157 R, 164, 36, 37; 174/59, 138 F, 72 C; 336/5, 10, 12

[56] References Cited

U.S. PATENT DOCUMENTS

| | | | |
|---|---|---|---|
| 1,334,276 | 3/1920 | Adams | 339/198 E X |
| 2,218,545 | 10/1940 | Morten | 339/222 N |
| 2,427,908 | 9/1947 | Hill | 339/198 J X |
| 2,740,001 | 3/1956 | Vergilio et al. | 339/198 X |
| 2,824,166 | 2/1958 | Madaras et al. | 339/198 E X |
| 2,917,724 | 12/1959 | Jackson | 339/198 E |
| 3,657,503 | 4/1972 | Smith | 339/222 X |
| 3,848,224 | 11/1974 | Olivero | 339/198 E |
| 4,113,341 | 9/1978 | Hughes | 339/222 X |

FOREIGN PATENT DOCUMENTS

| | | | |
|---|---|---|---|
| 1971623 | 5/1967 | Fed. Rep. of Germany . | |
| 1296532 | 5/1962 | France | 339/157 R |
| 323044 | 12/1929 | United Kingdom | 339/198 J |

*Primary Examiner*—Thomas J. Kozma

*Attorney, Agent, or Firm*—Cushman, Darby & Cushman

[57] ABSTRACT

A contact piece for providing conductive interconnection between the delta connection of the windings of a three-legged core transformer includes an insulative body having opposing vertical end surfaces in each of which a pair of end contacts is provided and an intermediate pair of opposing parallel horizontal surfaces in which a pair of opposing middle contacts are provided, the vertical separation between the pairs of end contacts and the pair of middle contacts being substantially equal. A transparent cover having horizontally separated and aligned apertures is also disclosed, the apertures being registered with one contact of each of the pairs of contacts.

13 Claims, 4 Drawing Figures

CONTACT PIECE FOR AIR-COOLED TRANSFORMERS HAVING CONDUCTIVE LINES

BACKGROUND AND SUMMARY OF THE INVENTION

The present invention relates to a contact piece for air-cooled transformers constructed of an insulating mass and provided with conductive lines in the interior thereof for providing switching connections to the delta connection of the three windings on a three-legged core transformer. In accordance with the contact piece of the present invention, the center connections are attached at the longitudinal sides of the contact piece opposite one another and are disposed in the area of the ends of the outside connections. The present invention is particularly suitable for use in transformers made of casting resin.

A contact strip of a contact piece of the initially mentioned type is generally known from the description in German Utility Patent No. 1,971,623. This known contact strip consists of an elongated, block-shaped body of synthetic resin in which three electric contacts are disposed on the two long, narrow sides. Such connecting blocks must be premanufactured serially in the sizes needed for adaptation to various transformer dimensions and must be maintained in stock. Thus, the problem of utilizing conventional contact pieces for air-cooled transformers is that such conventional contact pieces cannot be produced for any given standardized transformer type or size and thus cannot be produced in only one single size. Therefore, since the contact piece of the present invention can be manufactured in one size which would fit typical transformer sizes, the cost and stock inventory problems typically encountered with conventional contact pieces are alleviated.

This problem is solved by the contact piece according to the present invention in that at least in the case of one pair of outside connections disposed at one end of the contact piece, the connecting contacts are accessible from the direction of the vertical sides of the contact piece in the mounted position so that they are in the general area of the relative front sides thereof. As a result of this relative positioning of the connecting contacts, it is possible that one may dispense with laterally projecting contacts accessible only from the direction of the horizontal sides in the mounted position and advantageous results are achieved which are believed to have been heretofore unattainable with conventional contact pieces.

The individual connecting elements may be attached to the outside connecting contacts of the present invention and thus may be connected with the respective connecting contacts of the transformer windings.

The contact piece of the present invention is preferably symmetrical. In other words, two outside connections have been provided in the contact piece of the present invention at each side thereof. For such functions, the connecting contacts of the outside connections are preferably counter sunk into the front sides of the contact piece. The connecting contacts may also be in the form of brackets, eyes or wire hooks which will project more or less from the width of the insulating mass of the contact piece depending upon the specific mechanical and/or structural requirements.

The shape of the contact piece according to the present invention preferably deviates from the box or rectangular shape typically associated with conventional contact pieces. In a preferred embodiment of the present invention, the contact piece in top view has a narrowed cross section at least in the area of the middle connections as compared to the cross-sectional areas of the contact piece in the vicinity of each of the front sides. The contact piece therefore has the general appearance of an X- or an hour-glass like shape as viewed from above.

Because of this particular configuration of the contact piece, considerable quantities of material may be saved since the distance or creepage path between the blank surfaces of the connecting contacts of the middle connections disposed in the cross sectional constriction is essentially equal to the distance or the creepage path between the blank surfaces of the two connecting contacts in the area of the front sides.

Finally, the advantages of a contact piece according to the present invention also extend to the shaping of the customarily necessary protective cap. The latter is preferably shaped as an essentially U-shaped box in cross section which bridges the extreme horizontal distance between the connecting elements. The cap preferably defines three bores on its front side separated from one another by an equal distance and being disposed equally distant from the edge of the protective cap.

With the contact piece according to the present invention, assembly and installation work may be accomplished in a very short time thereby saving labor costs. Additionally, the contact piece may be produced at a more reasonable cost than the customary cuboid-shaped contact piece since one single contact piece will be sufficient for practically all transformer dimensions.

The body of the contact piece constructed of an insulating mass having the conductive lines inserted therein may be produced according to any known casting processes, for example, injection molding, die casting with cold-hardening casting resin in the open casting process or with hot-hardening casting resin in a vacuum. It is also possible to provide the connecting piece of the present invention in two parts, namely, a cover and a bottom, in which corresponding grooves are provided in which the conductive lines are placed.

Additional advantages and characteristics of the present invention will become more clear after careful consideration is given to the detailed description of the preferred exemplary embodiment which follows.

BRIEF DESCRIPTION OF THE ACCOMPANYING DRAWINGS

Preferred exemplary embodiments of the present invention are shown in the accompanying drawings to which reference will hereinafter be made and in which:

FIGS. 1*a* and 1*b* show a cast resin transformer with a three-legged core and the contact piece according to the invention, inclusive of a cover cap therefore, in front and in side views, respectively;

FIG. 2 shows a contact piece of the present invention in perspective view; and FIG. 3 shows the cover cap for the contact piece of the present invention.

DETAILED DESCRIPTION OF THE PREFERRED EXEMPLARY EMBODIMENT

Figure 1B:
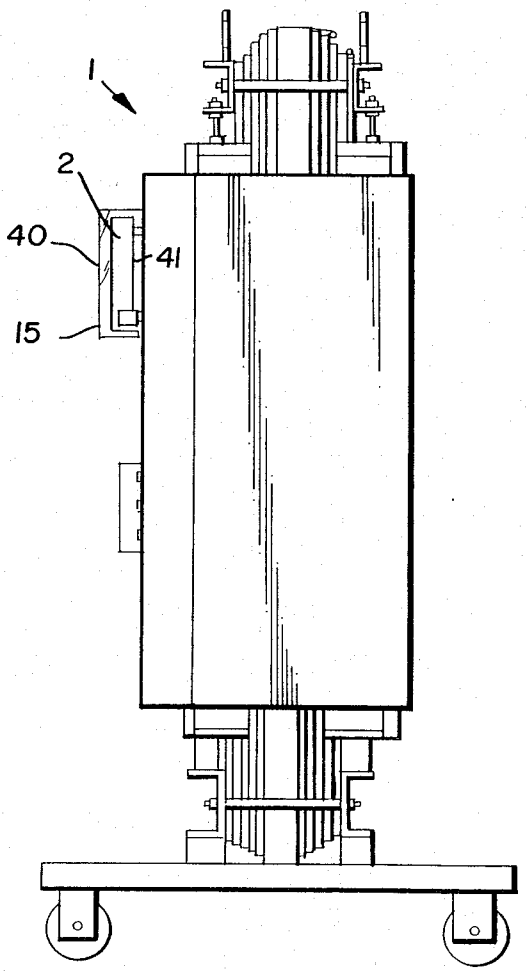
Figure 1A:
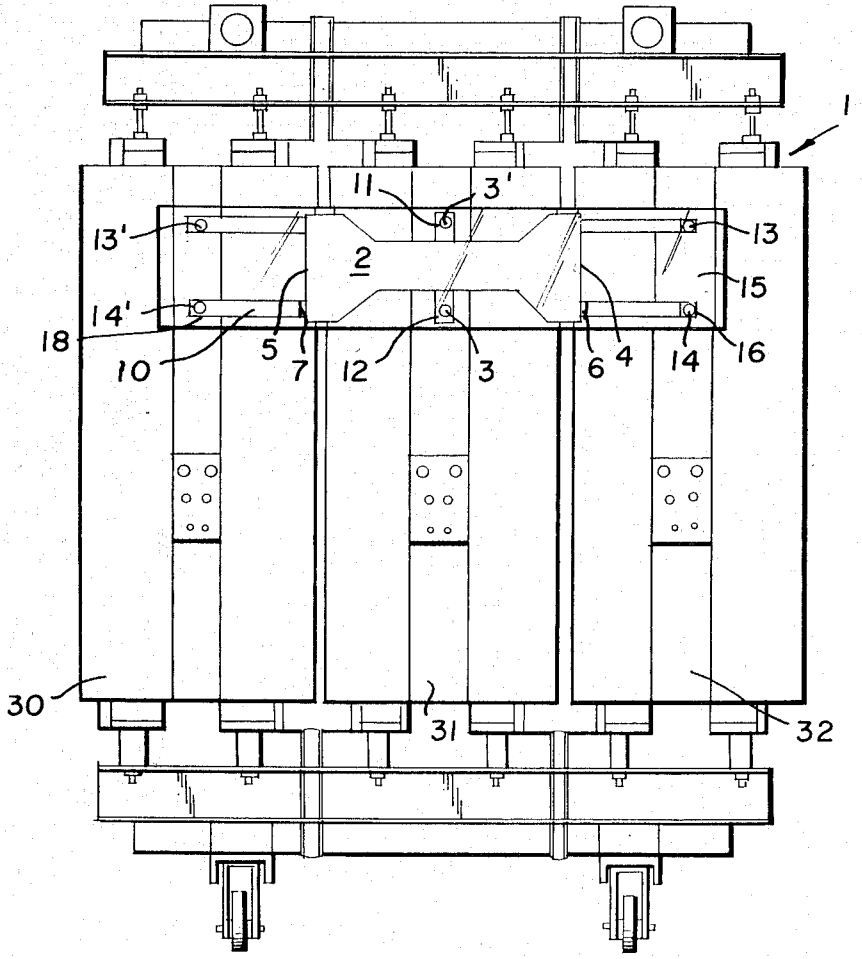

In FIGS. 1*a* and 1*b*, a three-phase, air-cooled transformer 1 is shown which carries, in a known manner, three windings 30, 31, 32 on a three-legged core. For the connection of the individual conductive lines of the windings 30–32, a connecting piece 2 according to the present invention is provided in the upper area of the winding arrangement. The connecting piece 2 is preferably constructed of an insulating mass, and more preferably a casting resin which is at least slightly flexible. The contact piece has the approximate shape of an hour glass in which case, front sides 4, 5 and base sides 40, 41 are disposed vertically when in the mounted position. Two opposing middle connections 3, 3' are provided in the longitudinal sides 33, 34, and are disposed relative to one another so as to lie along a common vertical axis. Additionally, a pair of separated outside connections 35, 36 are provided with connecting contacts 6, 6' or 7, 7' and are disposed along axes normal to the flat front sides 4, 5 so that they are also accessible from the sides of the contact piece 2 and are perpendicular to the vertical plane when in the mounted position.

As used herein and in the accompanying claims, the terms "horizontal" and "perpendicular" are to be understood in such a way that deviations from precisely horizontal or perpendicular surfaces are possible, for example, as a result of sides lying transversely or cut or curved sides.

The connecting contacts 6, 6' and 7, 7' are preferably formed as small blocks having tapped threads, while the connecting elements 9, 10 disposed between the connecting contacts 6,6' and 7,7', respectively, of the contact piece 2 and the connecting contacts 13', 14', 11', 12' and 13, 14, of the windings 30, 31 and 32, respectively are preferably provided as strips or wire-shaped structures, for example, brackets.

It is important that since the above-mentioned connecting contacts will be connecting with simple connecting elements 9, 10 (e.g. brackets or pieces of wire), that one single connecting piece be provided with connecting elements 9, 10 of sufficient length so that they can be cut or properly sized during installation to a certain length so that a great variety of various transformer dimensions can be readily accommodated.

Connecting lines 8 are disposed in the insulating mass between the connecting contacts 6, 6' or 7, 7', in a manner known per se, and include various points of interconnections between the connecting contacts 3, 3'; 6, 6'; or 7, 7'. At the same time, the connections are provided, for example, in such a way that the outside connecting contact 6' includes a connection point with the middle connection 3; the outside connecting contact 6 includes a connection point with the connecting element 7'; and the outside connecting contact 7 includes a connection point with the middle connection 3'. As a result of contact engineering considerations, it may become necessary that such connections be flexible so as to aid in the installation procedures. The relative positions of the connecting arrangements of the connecting contacts may thus be changed by inverting the contact piece 2, thereby changing the relative arrangement of the connecting lines themselves.

The connecting contacts 6, 6' or 7,7' may also be provided in the form of eyes, hooks, shoes etc., as desired, and can either be embedded into the insulating mass in the front sides 4, 5 or in the front or rear base side 40, 41 of the contact piece 2. Alternatively, the connecting contacts could project from the surfaces of contact piece 2.

Figure 2:
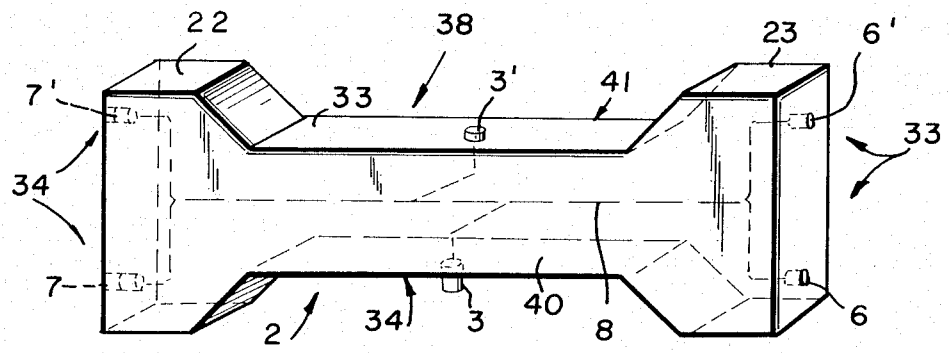

The contact piece 2 in top view has the approximate shape of an X or a general hourglass configuration. In the vicinity of the front sides 4, 5, the body of the contact piece 2 has been widened in the manner of a wing (e.g. opposing outwardly tapered portions), whereas in the middle area, that is, in that location where the contacts of the middle connections 3, 3' are disposed, the contact piece has a cross sectional constriction 38 when compared to the cross sectional area in the vicinity of the front sides 4, 5. As can be seen by referring to FIGS. 1*b* and 2, the connecting piece 2 is relatively flat and thin.

It is important that the distance or creepage path between the blank surfaces 11, 12 of the middle connection contacts along the surface of the contact piece 2 is essentially equal to the distance or the creepage path between the blank surfaces 13, 14; 13', 14' associated with the front side connecting contacts, 6, 6', 7, 7', respectively. Accordingly, the separation distance between the blank surfaces 13, 14; 13', 14' of the contact pairs are always substantially of equal size and, moreover, lie in parallel opposing planes. In the case of a minimal dimensioning of these separation distances, considerable savings may thus be achieved in material costs when manufacturing contact piece 2 of the present invention.

Figure 3:
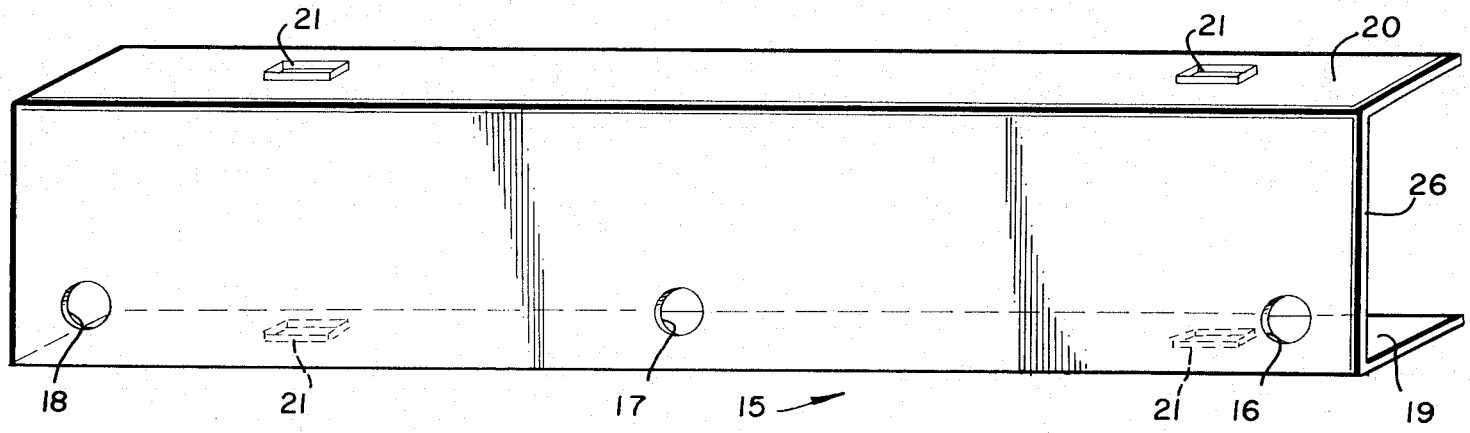

In use, a protective cap 15 is generally preferred for covering the individual connecting contacts. The position of the protective cap can be seen by referring to accompanying FIGS. 1*a* and 1*b* and a detailed representation thereof can be seen from FIG. 3. The protective cap 15 may be shaped, in cross section, essentially as a U-shaped box which is open on the opposing ends and on its rear side. The lateral walls 19, 20 together with the front side 26 form the U-shaped cross sectional profile.

The length of the protective cap 15 is dimensioned according to the distance between the contacts 13, 14 or 13', 14' based on the windings lying the farthest to the outside. The protective cap 15 preferably projects somewhat laterally beyond such dimension. In order to permit the transformer connections to be extended to points away from the transformer, the protective cap 15 defines three apertures 16, 17, 18 lying substantially the same distance apart from one another. Thus, apertures 16, 17 and 18 are a fixed distance from the lateral edge of the protective cap 15. These three apertures 16, 17, 18 are therefore aligned and are customarily defined in the protective cap in a predetermined manner whenever the distance of the connecting contacts 14, 12, 14' is known. When the circuit is shifted, e.g. when the other connecting contacts 13', 11, and 13 serve as connections which lead to the outside, it is only necessary to turn the protective cap by 180°, whereby the apertures 16–18 again lie in a position in registry with contacts 13', 11 and 13, except, of course, they are then aligned along the upper portion of cap 15.

On the interiors of side walls 19, 20 of the protective cap 15, retaining members 21 are provided which engage, in a snap-fitting relationship, with the lateral flanks 22, 23 of the contact piece 2 so as to hold cap 15 in place. This attachment is possible since no connecting contacts are present at the lateral flanks 22, 23 so that retaining members 21 can directly engage flanks 22, 23 without interference from the contacts of the middle connections 3, 3' lying in the cross sectional constriction 8. Preferably, the center-to-center distance of the bores 16, 17 and 18 are dimensioned so as to be substantially equal to the center-to-center distance of the core legs of the transformer 1.

A transparent polycarbonate is preferably utilized as the material for constructing the protective cap 15, the polycarbonate material is also preferably self-quenching or fire retardant so that any danger of fire is correspondingly lessened.

Thus, as a result of the special shape formation and selection of the working materials for the contact piece 2 and the protective cap 15, a series of advantages results which together make possible an assembly having less problems as well as being less expensive to produce and, moreover, facilitates more secure production of these parts for transformers.

What is claimed is:

1. An apparatus suitable for providing conductive interconnection between the delta connection of the windings of a three-legged core transformer, said apparatus comprising:

a solid body of an insulative material and including means defining opposing vertical parallel end surfaces, first and second pairs of end contacts respectively provided in said end surfaces, and means defining opposing horizontal surfaces intermediate said vertical end surfaces, each said intermediate surface including a respective contact of a pair of opposing middle contacts, said contacts of said first and second pairs of end contacts and said pair of middle contacts being separated by a predetermined substantially equal dimension to provide access to each contact of said pairs of contacts, and conductive means embedded in said body for electrically interconnecting said pairs of contacts in a predetermined manner, means in said solid body defining plural countersunk cavities each for housing a respective contact of said first and second pairs of end contacts, and wherein said body in the vicinity of said end surface has a cross-sectional dimension greater than the cross-sectional dimension of said body as measured between said opposing horizontal surfaces, said body thereby establishing an hour-glass configuration.

2. An apparatus as in claim 1 wherein said contacts are threaded to accommodate a connecting screw.

3. An apparatus as in claim 1 further comprising means defining first and second pair of conductive strips of preselected length operatively connected to said first and second pairs of end contacts for connecting said first and second pairs of end contacts to a predetermined pair of said windings.

4. An apparatus as in claim 1 further comprising a protective cover means removably connected to said body for covering and protecting said body, said cover means being substantially U-shaped in cross-section and having a length at least equal to the horizontal distance between said first and second pairs of end contacts.

5. An apparatus as in claim 4 wherein said cover means includes means defining at least three horizontally aligned and separated apertures being disposed near a predetermined edge of said cover means, each of said apertures being registered with a respective one of said contacts of said first and second pairs of contacts and a respective one of said contacts of said pair of middle contacts.

6. An apparatus as in claim 4 wherein said cover means further includes coupling means on the interior surfaces of the legs of said U-shaped cover means for engaging the opposing side edge of said body to removeably couple said cover means to said body.

7. An apparatus as in claim 6 wherein said cover means is constructed of a transparent material.

8. An apparatus as in claim 7, wherein said material is self-quenching.

9. An apparatus as in claim 8 wherein said material is polycarbonate.

10. A three-legged core transformer including plural core windings, each having a core leg, and interconnection means for providing conductive interconnection between the core windings and to establish a delta circuit connection thereof, said interconnection means comprising:

a solid body of an insulative material and including means defining opposing vertical parallel end surfaces, first and second pairs of end contacts respectively provided in said end surfaces, and means defining opposing horizontal surfaces intermediate said vertical end surfaces, each said intermediate surface including a respective contact of a pair of opposing middle contacts, said contacts of said first and second pairs of end contacts and said pair of middle contacts being separated by a predetermined substantially equal dimension to provide access to each contact of said pairs of contracts, and conductive means embedded in said body for electrically interconnecting said pairs of contacts in a predetermined manner, means in said solid body defining plural countersunk cavities each for housing a respective contact of said first and second pairs of end contacts, and wherein said body in the vicinity of said end surface has a cross-sectional dimension greater than the cross-sectional dimension of said body as measured between said opposing horizontal surfaces, said body thereby establishing an hour-glass configuration.

11. A transformer as in claim 10 wherein the center-to-center spacing between said apertures is substantially equal to the center-to-center spacing between the core legs of said transformer.

12. A transformer as in claim 10 wherein said contacts are threaded to accommodate a connecting screw.

13. A transformer as in claim 10 further comprising means defining first and second pairs of conductive strips of preselected length operatively connected to said first and second pairs of end contacts for connecting said first and second pairs of end contacts to a predetermined pair of said windings.

* * * * *